United States Patent [19]

Schonbrun

[11] Patent Number: 4,980,215

[45] Date of Patent: Dec. 25, 1990

[54] ABSORBENT PACKAGE

[75] Inventor: Keith M. Schonbrun, New York, N.Y.

[73] Assignee: Aldine Technologies, Inc., New York, N.Y.

[21] Appl. No.: 237,593

[22] Filed: Aug. 26, 1988

[51] Int. Cl.[5] ..... B32B 3/00

[52] U.S. Cl. ..... 428/72; 383/109; 426/415; 428/68; 428/74; 428/76; 428/121; 428/192; 428/283; 428/297; 428/296; 428/913; 428/131

[58] Field of Search ..... 428/284, 286, 283, 402, 428/913, 296, 297, 298, 224, 304.4, 304.6, 192, 131, 68, 72, 74, 76; 383/109; 426/415

[56] References Cited

U.S. PATENT DOCUMENTS

| | | | |
|---|---|---|---|
| 3,923,238 | 12/1975 | Thomas | 229/48 T |
| 3,990,872 | 11/1976 | Cullen | 55/274 |
| 4,332,845 | 6/1982 | Nawata et al. | 428/35 |
| 4,364,992 | 12/1982 | Ito et al. | 428/283 |
| 4,429,001 | 1/1984 | Nakanishi et al. | 428/283 |
| 4,485,133 | 11/1984 | Ohtsuka et al. | 428/35 |
| 4,487,791 | 12/1984 | Komatsu et al. | 428/35 |
| 4,552,767 | 11/1985 | Saleeb et al. | 426/395 |
| 4,578,068 | 3/1986 | Kramer et al. | 428/283 |
| 4,579,223 | 4/1986 | Otsuka et al. | 206/204 |
| 4,657,133 | 4/1987 | Komatsu et al. | 206/204 |
| 4,667,814 | 5/1987 | Wakamatsu et al. | 206/0.7 |
| 4,735,850 | 4/1988 | Eitman | 428/283 |
| 4,758,239 | 7/1988 | Yeo et al. | 428/283 |
| 4,929,480 | 5/1990 | Midkiff et al. | 428/283 |

FOREIGN PATENT DOCUMENTS

| | | |
|---|---|---|
| 53-117684 | 10/1978 | Japan . |
| 54-010291 | 1/1979 | Japan . |
| 54-033287 | 3/1979 | Japan . |
| 55-107465 | 8/1980 | Japan . |
| 56-013018 | 2/1981 | Japan . |
| 59-163175 | 3/1984 | Japan . |
| 60-058354 | 4/1985 | Japan . |

OTHER PUBLICATIONS

Spaulding, M. *Oxygen Absorbers Keep Food Fresher.*

Air Products and Chemicals, Inc., *AIRFLEX® Ethylene-Vinyl Chloride (EVCL) Emulsions for Specialty Papers* (1984).

DuPont, *TYVEK® Territory . . . Beyond the Limits of Conventional Packaging Materials.*

H. Forcinio, "Mineral Packet Absorbs Gases", *Food & Drug Packaging,* pp. 3, 41 (Sep. 1985).

B. Root, "Minimize Inventory Loss by Controlling Moisture", *Food & Drug Packaging,* (Jul. 1987).

*Primary Examiner*—James J. Bell

*Attorney, Agent, or Firm*—Pennie & Edmonds

[57] ABSTRACT

The absorbent package of this invention includes a mono-layer, flexible, nonwoven fibrous web, heat sealed to itself and an absorbent sealed within the fibrous web. The fibrous web is permeable to both gas and water. The fibrous web includes a first phase and a second phase. The first phase includes long cellulosic fibers which comprises from about 65 to about 70% of the overall fibrous web. The second phase includes synthetic and thermoplastic fibers which comprise from about 30 to about 35% of the overall fibrous web. The fibrous web further includes a plurality of pores with tortuously configured pore channels. The pores have a pore size range from a high of about 0.00466 microns to a low of about 0.00099 microns to provide absolute containment of the absorbent within the package. The pores are distributed throughout the fibrous web in a manner whereby any fluid which is exteriorly disposed proximate to the package is transferred through the pores and is absorbed by the absorbent and, at the same time, is wicked by the fibers, thereby providing a rapid transfer of the fluid into the absorbent package.

25 Claims, 1 Drawing Sheet

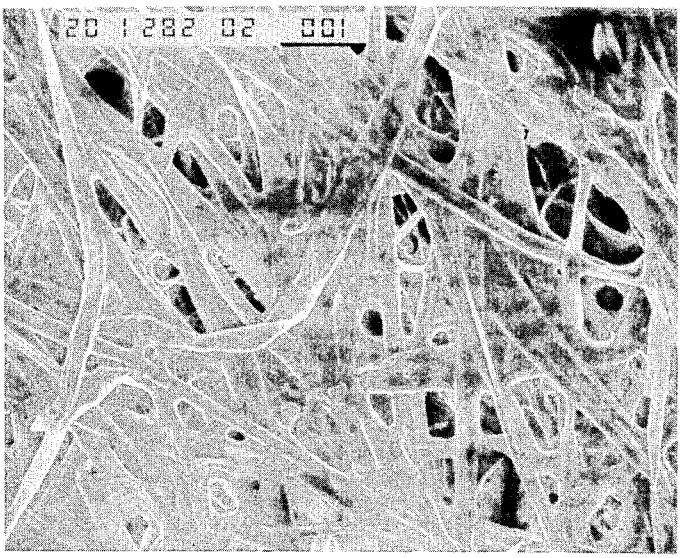
20 1 282 02 001

ABSORBENT PACKAGE

BACKGROUND OF THE INVENTION

1. Field of the Invention

This invention relates generally to packaging and, more particularly, to an absorbent package which, when placed in a sealed package or container, substantially eliminates the deleterious effect that certain gases, which are typically present in the head space of the sealed package or container, have upon the particular item stored within the package or container.

2. Description of the Background Art

In the art of packaging, the skilled artisan is continuously endeavoring to develop techniques for maintaining the quality and integrity of items stored in packages, such as, by prolonging the shelf life of the particular item or items contained in the package. Items stored within a package are typically affected by the surrounding environment and are oftentimes adversely affected by the gases present in the head space or free space within the interior of the package.

One specific gas that is problematic in this context is oxygen. Specifically, where the packaged items are foodstuffs, the presence of oxygen can create an environment in which molds or eumycetes, bacteria and insects will thrive, which ultimately leads to putrefaction and a change in the quality of the packaged foodstuffs, which are typically exemplified by oxidative color and flavor changes. Additionally, oxidation of the foodstuffs can adversely affect their taste. Cheeses, nuts, coffee, processed meats, cakes, confections and dried fruits are representative of some of the foodstuffs which can be adversely affected in the presence of oxygen.

The need to minimize the concentration of oxygen within a package containing foodstuffs has not gone unrecognized. U.S. Pat. No. 4,332,845 describes an oxygen absorbent-containing bag fabricated from water impermeable laminated sheets. The oxygen absorbent contained within the bag absorbs oxygen present in its surrounding environment, such as when it is placed within a package containing foodstuffs, thereby preventing putrefaction or a change in the quality of the foodstuff. Similarly, U.S. Pat. No. 4,485,133 describes an oxygen absorbent package which includes a water impermeable multi-layer structure, intended to accommodate an oxygen absorbent to prevent damage to the foodstuffs contained in a package.

The adverse affect of oxygen is further manifested where the packaged items are metallic and subject to oxidation which ultimately leads to product degradation or, at best, an aesthetically unacceptable product. This problem is typically encountered in the art of manufacturing electronic components.

It is also desirable to minimize the amount of carbon dioxide present in the head space of sealed packages, especially in the coffee packaging art. When coffee is packaged, whether in the form of roasted or ground coffee or whole coffee beans, the package will balloon as evolved carbon dioxide is liberated from the coffee and eventually the container will break and its contents will be ruined. Even in the event that the package does not rupture, the evolved gases will create an expansion of the package that will render the package unattractive from a consumer standpoint.

In response to this problem, those skilled in the art have developed certain degassing procedures, which suffer a host of disadvantages from the perspective of cost, equipment and time. Another approach to solving this problem is by packaging coffee with an absorbent package containing carbon dioxide sorbents, such as those described in U.S. Pat. No. 4,552,767. However, in these systems, additional problems have been encountered. The problem concerns the slow uptake of $CO_2$, which results in unequal pressure on the inside and outside of the walls of the coffee container. The container, a bag comprised of a lamination of paper, foil and sealants, softens, distorts and collapses over time, rendering the product unsuitable for shipment and distribution.

The absorbent package of the present invention is offered as an improvement over those which have been heretofore provided. In addition to absorbing unwanted gases from the head space within sealed packages, the absorbent package of the present invention has a wide range of potential applications, inasmuch as it is offered as a means for controlling the conditions of its surrounding environment and is particularly well adapted to control or reduce odors and moisture, which is advantageous in the packaging of pharmaceutical products.

The absorbent package of the present invention possesses some of those characteristics typically exhibited by nonwoven, long fibered materials. Generally speaking, a nonwoven, long fibered material and the absorbent package of this invention are both gas and water permeable, flexible, heat sealable and have a mono-layered structure.

The fibrous web structure used to make the absorbent package of the present invention is somewhat similar, in certain limited respects, to TYVEK®, a spunbonded olefin available from DuPont Company, Wilmington, Delaware. Notwithstanding, the package of this invention exhibits certain characteristic properties which make it a superior absorbent package when compared to packages fabricated from TYVEK®. Thus, while TYVEK® is a known material used in controlled atmosphere packaging applications, it possesses certain shortcomings relative to the absorbent package of this invention. Specifically, it does not heat seal to itself easily. Rather, hot melts and pressure sensitive adhesives are required to obtain strong seals. Additionally, TYVEK® begins to melt at about 275° F. and destroys the fiber structure, reducing both flexibility and tear strength in the seal area. Furthermore, TYVEK® is impervious to water.

SUMMARY OF THE INVENTION

In accordance with the present invention, an absorbent package is provided which comprises a mono-layer fibrous web which is heat sealed to form an enclosure and an absorbent sealed within the mono-layer fibrous web enclosure. The mono-layer fibrous web has an arrangement of natural and synthetic fibers and a plurality of pores with tortuously configured pore channels. The pores have a diameter at least as small as the diameter of the absorbent particles to provide absolute containment of the absorbent within the package. The pores are distributed throughout the fibrous web in a manner whereby any fluid, such as, gas and/or water, which is exteriorly disposed proximate to the package is transferred through the pores and absorbed by the absorbent and, at the same time, is wicked by the fibers, thereby providing a rapid transfer of the fluid into the absorbent package.

In a preferred embodiment, the absorbent package of this invention includes a mono-layer, flexible, nonwoven fibrous web, which is heat sealed to form an enclosure and an absorbent sealed within the fibrous web enclosure. The fibrous web is permeable to, both gas and water. The fibrous web includes a fiber mixture of a first phase and a second phase. The first phase includes long cellulosic fibers which comprise from about 65 to about 70% of the overall mixture in the fibrous web. The second phase includes synthetic or thermoplastic fibers which comprise from about 30 to about 35% of the overall fibrous web. The fibrous web further includes a plurality of pores with tortuously configured pore channels. The pores have a pore size range from a high of about 0.00466 microns to a low of about 0.00099 microns.

It has advantageously been discovered that the absorbent package of the present invention overcomes those problems associated with the slow uptake of fluids, such as, $CO_2$. This advantage is ascribed to the dual phenomena of absorption through the pores and the wicking through the fibers which, in turn, is ascribed to the combination of the mono-layer of the fibrous web, the size and area distribution of the pores, the particular cellosic and thermoplastic fiber blend and the capillary action provided by the fibers. Wickability is simply not available in multi-layer absorbent packages, inasmuch as the additional layers act as barriers to the fluids. Additionally, the asymmetric nature of the present absorbent package permits the rapid influx of water and/or moisture into the package and permits containment of water and/or moisture in the package, since the efflux of water and/or moisture from the bag is substantially nonexistent.

DESCRIPTION OF THE DRAWINGS

FIG. 1 is a quantitative image analysis of the absorbent package of this invention illustrating the pore configuration and distribution.

DESCRIPTION OF THE PREFERRED EMBODIMENTS

The absorbent package of the present invention is fabricated from a fibrous web structure that is permeable to all fluids, flexible and heat sealable. For purposes of this description, and within the meaning of the claims, the term fluid shall be interpreted as any liquid or gas that is capable of flowing. The fibrous web structure is a mono-layer, nonwoven, self-supporting structure having a plurality of fine sieve openings or pores.

The fibrous web structure is comprised of two phases. The first phase is 100% long cellulosic fibers, specifically, manilla hemp and wood fibers. The first phase comprises about 65 to about 70% of the overall fibrous structure and is engineered, as described hereinbelow, to provide pore size control and good printability. The wood fibers of the first phase are about 1mm to about 3mm in length, with an average length to diameter ratio of about 75. The manilla hemp fibers of the first phase are about 5mm to about 6mm in length, with an average length to diameter ratio of about 300. Additionally, the manilla hemp fibers impart a high level of tenaciousness to the overall package.

The second phase comprises about 30 to about 35% of the overall fibrous structure and includes synthetic and thermoplastic fibers, most preferably polypropylene fibers, of which about 83 to about 85% are about 10mm in length. Polypropylene fibers are preferred over other olefin fibers because of their ability to absorb moisture and, additionally, because of the contribution made by polypropylene to the heat sealability of the overall fibrous web structure. Other olefin fibers which satisfy these criteria are also regarded as preferred fibers. The remaining synthetic fibers are micron-sized in diameter and shorter, averaging about 1mm in length. The second phase imparts excellent strength, permeability and heat sealability to the fibrous structure and, ultimately, the absorbent package.

The fibrous blend and the length and diameter of the fibers used to make the fibrous web structure are significant in the sense that they enable the absorbent package to possess an excellent combination of density, pore size and pore area distribution resulting in a superior morphology which enhances the efficiency of the ultimately formed absorbent package, which efficiency is manifested by a rapid gas transfer from the head space of the package containing the stored item to within the absorbent package.

The air permeability of the fibrous web structure, as determined by the Frasier scale of evaluating permeability, is about 9 to about 40 cubic feet of air passing through a square foot of web per minute (CFM).

The fibrous web structure is made by suspending the aforedescribed fibers of the first phase in water to obtain a uniform dispersion. The resulting fiber slurry is fed from a headbox onto an inclined wire mesh screen which is positioned downstream of the headbox. A suspension or dispersion of the fibers of the second phase are simultaneously fed from a second headbox onto the inclined wire mesh-screen. As the two dispersions flow onto the wire mesh screen, the water passes through the screen, resulting in a random co-mingling at the interface of the two phases. The two phases become locked together as the nonwoven web is formed, but the fibers of each phase do not penetrate the opposite surface. The random co-mingling produces an improved pore distribution and the formation of the web in this manner avoids the materialization of fiber bundles, thereby resulting in a denser, more uniform and, hence, stronger web.

Any excess water present on or within the web is squeezed out of the web and any residual water is removed by drying.

The fibers are bonded either prior to and/or during the drying step. Any heat sealable thermoplastic binder, which demonstrates at least a moderate degree of hydrophobicity, may be employed. The binder is the most hydrophobic component of the fibrous web structure and permeates throughout the web as a flowable emulsion via a saturation process. In a preferred embodiment, the binder is an ethylene vinyl chloride binder, which is a terpolymer of ethylene, vinyl chloride and a third monomer which imparts amide or carboxyl functionality. The binder constitutes from about 12% to about 17% of the total mass of the fibrous web structure and is the thermoplastic ingredient of the fibrous web structure which, in cooperation with the polypropylene fibers, contributes to the heat sealability of the fibrous web structure.

The preferred binder used in the fibrous web structure has slight to moderate water vapor and gas barrier properties, thus rendering the absorbent package of this invention substantially gas permeable. The binder also imparts a resistivity to common oils; the degree of resistivity is dependent upon the amount of the binder that covers the surface of the web rather than becoming lost in the interior and interstices of the web. One such ethylene vinyl chloride emulsion usable as a binder in the fibrous web structure is identified as AIRFLEX® and is available from AirProducts and Chemicals, Inc. Allentown, Pennsylvania. . The aforedescribed fibrous web structure is commercially available as XL Web No. 9579 from Dexter Corporation, C.H. Dexter Division, Windsor Locks, Connecticut.

The mono-layer fibrous web structure provided, as described above, possesses excellent characteristics with respect to pore size, pore channel configuration and pore distribution, thus making it particularly well suited as a package adapted to contain an absorbent which is to be subsequently placed in a package containing an item or items desired to be protected from gases, such as oxygen and carbon dioxide, or a dessicant used to absorb moisture. As stated earlier, the structural arrangement of the absorbent package of this invention advantageously provides a dual phenomena of absorption through the pores and wicking through the fibers.

The pores distributed throughout the mono-layer fibrous web structure have a pore size range from a high of about 0.00466 microns to a low of about 0.00099 microns and are at least as small, and preferably smaller, in diameter than the diameter of the particular absorbents and/or dessicants employed. Thus, the pore size contributes to the absolute containment of the absorbent within the package. Additionally, as depicted in FIG. 1, the pore channels are tortuously configured which results from the two specific fibrous phases of the overall structure and the way the mono-layer fibrous web structure is manufactured, as described above, and which further enhances absolute containment of the absorbents within the package of this invention. Furthermore, the good wickability of the absorbent package of this invention is ascribed to the pore size and pore distribution, as well as to the capillary action provided by the polypropylene fibers. The pore size and pore distribution also contribute to the rapid gas transfer and eliminate any sifting problems.

The mono-layer structure of the fibrous web used to make the absorbent package of this invention also contributes to a rapid gas transfer from the head space within the package containing the stored items to the absorbent package. The improved rapid gas transfer characteristic of the present absorbent package is believed to directly enhance the shelf life of the item contained within the package.

The mono-layer fibrous web structure is water permeable and, therefore, can absorb a prescribed percentage i.e., about 15%, of moisture by weight to facilitate the uptake of carbon dioxide more rapidly. It is the pore area distribution which imparts hydrophillic properties to the ultimately formed absorbent package. Thus, the absorbent package of this invention exhibits both hydrophobic and hydrophilic properties.

The mono-layer fibrous web structure described above can be fabricated into an absorbent package in any known manner, such as, by heat sealing. Any horizontal and vertical pouch forming, filling and sealing apparatus may be employed. A particularly preferred apparatus used for fabricating the absorbent package of the present invention is the BARTELT® Intermittent Motion Flexible Pouch Packager, available from Rexham Machinery Group, BARTELT® Machinery Division, Rexham Corporation, 5501 N. Washington Blvd., Sarasota, Florida. .

Any conventional oxygen absorbent or adsorbent, carbon dioxide absorbent or adsorbent or moisture absorbing or adsorbing dessicant may be used with the absorbent package of the present invention. As merely illustrative, exemplary absorbents include particles of calcium oxide, sulfites, hydrogen sulfites, thiosulfates, dithionites, hydroquinone, catechol, resorcinol, pyrogallol, gallic acid, sodium formaldehyde sulfoxylate, ascorbic and isoascorbic acid and their salts, sorbose, glucose, lignin, dibutylhydroxytoluene butylhydroxyanisole, ferrous salts and metal powders such as iron powder. Carbon dioxide evolving oxygen absorbents or carbon dioxide-absorbing oxygen absorbents may also be used.

The following examples are provided to further illustrate the absorbent package of this invention. Accordingly, these examples should not be construed as limiting the true scope and content of the present invention.

EXAMPLE 1

Certain properties of a sample of XL Web No. 9579 from Dexter Corporation were tested. The data resulting from such tests are set forth below in Table I.

TABLE I

| Properties Tested | XL (#9579) |
|---|---|
| GRAMMAGE (g/m) | 70.0 |
| BASIS WEIGHT (lbs/2880 ft) | 42 |
| WEIGHT/UNIT AREA (oz/yd) | 2.1 |
| AIR PERMEABILITY (L/min/100 cm @12.7 mm H2O) | 30 |
| THICKNESS | |
| (microns) | 187 |
| (inches) | (0.00737) |
| TENSILE STRENGTH | |
| Dry MD (g/25 mm) | 8175 |
| Dry CD (g/25 mm) | 4275 |
| Wet CD (g/25 mm) | (*) |
| TRAPEZOID TEAR STRENGTH | |
| MD (g) | 289 |
| CD (g) | 368 |
| DRY DELAMINATION(!) | |
| MD (g) | 895 |
| CD (g) | 773 |
| MULLEN | 24.5 |
| BURSTING STRENGTH (psi) | |

(*)Data not available
(!)The web was tested for .5 seconds at 375° F. and 72 PSI.

EXAMPLE 2

In this example, a sample of the fibrous web structure of the present invention was evaluated to determine pore size measurement, pore distribution, mean pore size, applicable sieve/mesh number, elemental analysis of fibrous and binder constituents and photomicrograph documentation. A scanning electron microscope (SEM) fitted with an energy dispersive x-ray analyzer (EDS) provided the instrumentation for specimen analysis.

Representative sections were taken from a $8\frac{1}{2}\times 11$ inch specimen and affixed to pyrolytic graphite planchets via conductive carbon paste. These sample mounts were then coated with roughly 200 angstroms of carbon to provide the surface conductivity required for scanning electron microscopy. The prepared specimen mounts were inserted directly into the electron optical vacuum chamber and oriented to provide optimum conditions for EDS microanalysis and subsequent quantitative image analysis (QIA).

A graphics tablet/light pen hardware unit was selected to provide physical porosity characteristics. The SEM photomicrographs depicted in FIG. 1 were used to provide the reported mean pore area and distribution data. A predescribed surface area (14928.9675 microns) was analyzed using the light pen/tablet as interfaced to a microcomputer. A total of 135 defined pores were measured for individual, fractional and cumulative area indicies.

In this specific analysis of the 135 defined pores, the average or mean pore area was calculated from each of the individual values measured. The average pore area was 19.8655483 microns, which is considered to be extremely rare in a filter medium of this density.

Also, in this specific test, the pore area distribution, which is a ratio of the total number of voids to the total area of material, was determined to be 16.98% of the total area.

What is claimed is:

1. An absorbent package which comprises a monolayer fibrous web which is heat sealed to form an enclosure; and an absorbent in the form of particles sealed within said enclosure, said mono-layer fibrous web having an arrangement of natural and synthetic fibers and a plurality of pores with tortuously configured pore channels, said pores having a diameter at least as small as the diameter of said absorbent particles to provide absolute containment of said absorbent particles within said enclosure, and said pores being distributed throughout said fibrous web monolayer in a manner whereby any fluid which is exteriorly disposed proximate said package is transferred through said pores and is absorbed by said absorbent and, at the same time, is wicked by said fibers, thereby providing a rapid transfer of said fluid into said absorbent package.

2. The absorbent package of claim 1 wherein said fibrous web fiber arrangement comprises a blend of a first phase of long cellulosic fibers and a second phase of synthetic fibers.

3. The absorbent package of claim 2 wherein said long cellulosic fibers include manilla hemp and wood fibers and said synthetic fibers include thermoplastic fibers.

4. The absorbent package of claim 3 wherein said wood fibers are about 1mm to about 3mm in length with an average length to diameter ratio of about 75 and wherein said manilla hemp fibers are about 5mm to about 6mm in length with an average length to diameter ratio of about 300.

5. The absorbent package of claim 2 wherein said first phase comprises from about 65 to about 70% of the overall blend in the fibrous web.

6. The absorbent package of claim 2 wherein about 83 to about 85% of said synthetic fibers are about 10mm in length.

7. The absorbent package of claim 2 wherein said synthetic and thermoplastic fibers are fabricated from moisture absorbing, heat sealable olefins.

8. The absorbent package of claim 2 wherein said synthetic and thermoplastic fibers are polypropylene fibers.

9. The absorbent package of claim 2 wherein said second phase comprises from about 30 to about 35% of the overall blend in the fibrous web.

10. The absorbent package of claim 1 wherein said fibrous web is flexible, nonwoven and is permeable to fluids.

11. The absorbent package of claim 2 wherein said fibers of said first and second phases are bonded together by a heat sealable thermoplastic binder.

12. The absorbent package of claim 11 wherein said binder is an ethylene vinyl chloride binder.

13. The absorbent package of claim 11 wherein said binder comprises about 12% to about 17% of the total mass of the fibrous web.

14. The absorbent package of claim 1 wherein the size of said pores range from a high of about 0.00466 microns to a low of about 0.00099 microns.

15. The absorbent package of claim 1 wherein said fibrous web absorbs about 15% of moisture by weight, thereby facilitating the rapid uptake of carbon dioxide gas.

16. The absorbent package of claim 1 wherein said absorbent includes an oxygen absorbent, a carbon dioxide absorbent and a moisture absorbent.

17. The absorbent package of claim 16, wherein said absorbent is selected from the group consisting of particles sulfites, hydrogen sulfites, thiosulfates, dithionites, hydroquinone, catechol, resorcinol, pyrogallol, gallic acid, sodium formaldehyde sulfoxylate, ascorbic and isoascorbic acid and their salts, sorbose, glucose, lignin, dibutylhydroxytoluene, butylhydroxyanisole, ferrous salts and metal powders or calcium oxide.

18. The absorbent package of claim 1 wherein said fibrous web has an air permeability of about 9 to about 40 CFM.

19. An absorbent package comprising a mono-layer, flexible, nonwoven fibrous web, which is heat sealed to form an enclosure, said fibrous web being permeable to gas and water; and an absorbent in the form of particles sealed within said enclosure, said fibrous web monolayer including:

(a) a fiber blend having a first phase and a second phase, said first phase including long cellulosic fibers which comprise from about 65 to about 70% of the overall fibrous web, said second phase including thermoplastic fibers which comprise from about 30 to about 35% of the overall fibrous web; and (b) a plurality of pores with tortuously configured pore channels, wherein the size of said pores range from a high of about 0.00466 microns to a low of about 0.00099 microns to provide absolute containment of said absorbent particles within said enclosure, said pores being distributed throughout said fibrous web in a manner whereby a fluid which is exteriorly disposed proximate said package is transferred through said pores and absorbed by said absorbent, and, at the same time, is wicked by said fibers, thereby providing a rapid transfer of said fluid into said absorbent package.

20. The absorbent package of claim 19 wherein said long cellulosic fibers are manilla hemp and wood fibers, said wood fibers being about 1mm to about 3mm in length with an average length to diameter ratio of 75, said manilla hemp fibers being about 5mm to about 6mm in length with an average length to diameter ratio of about 300.

21. The absorbent package of claim 19 wherein the fibers of said first phase and said second phase are bonded together with an ethylene vinyl chloride binder comprising about 12% to about 17% of the total mass of the fibrous web.

22. The absorbent package of claim 19 wherein said fibrous web has an air permeability of about 9 to about 40 CFM.

23. An absorbent package comprising a mono-layer, flexible, nonwoven fibrous web being permeable to gas and water and which is heat sealed to form an enclosure for an absorbent; and an absorbant in the form of particles sealed within said enclosure of said heat-sealed fibrous web, said mono-layer fibrous web including:

(a) a blend of fibers in a first phase and a second phase, said first phase including long cellulosic fibers which comprise from about 65 to about 70% of the overall fibrous web, said second phase including synthetic fibers which comprise from about 30 to about 35% of the overall fibrous web; and (b) a plurality of pores with tortuously configured pore channels, wherein the size of said pores range from a high of about 0.00466 microns to a low of about 0.00099 microns to provide absolute containment of said absorbent particles within said package, said pores being distributed throughout said fibrous web in a manner whereby a fluid which is exteriorly disposed proximate said package is transferred through said pores and absorbed by said absorbent particles, and, at the same time, is wicked by said fibers, thereby providing a rapid transfer of said fluid into said absorbent package.

24. The absorbent package of claim 23 wherein two separate sheets of said fibrous material are heat-sealed around their peripheral edges to form said enclosure.

25. The absorbent package of claim 23 wherein a sheet of said fibrous material is folded upon itself and is heated sealed around the three non-folded peripheral edges to form said enclosure.

* * * * *